US009676585B2

(12) United States Patent
Kiriyama et al.

(10) Patent No.: US 9,676,585 B2
(45) Date of Patent: Jun. 13, 2017

(54) POST-PROCESSING DEVICE AND IMAGE FORMING SYSTEM

(71) Applicant: KONICA MINOLTA, INC., Chiyoda-ku, Tokyo (JP)

(72) Inventors: Tomohiro Kiriyama, Yamanashi (JP); Teruhiko Toyoizumi, Tokyo (JP); Shohei Otsu, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 66 days.

(21) Appl. No.: 14/618,782

(22) Filed: Feb. 10, 2015

(65) Prior Publication Data

US 2015/0266693 A1 Sep. 24, 2015

(30) Foreign Application Priority Data

Mar. 18, 2014 (JP) ..... 2014-055164

(51) Int. Cl.
*B65H 35/02* (2006.01)
*B26D 7/18* (2006.01)
(Continued)

(52) U.S. Cl.
CPC ..... *B65H 35/02* (2013.01); *B02C 18/06* (2013.01); *B02C 18/18* (2013.01); *B02C 18/22* (2013.01); *B26D 7/18* (2013.01); *B26D 7/2635* (2013.01); *B41F 13/58* (2013.01); *B41J 11/70* (2013.01); *B26D 1/245* (2013.01); *B26D 2007/005* (2013.01); *B65H 2301/5155* (2013.01); *B65H 2301/515323* (2013.01); *B65H 2513/22* (2013.01); *B65H 2701/1315* (2013.01); *B65H 2801/27* (2013.01); *G03G 2215/00814* (2013.01); *Y10T 83/2087* (2015.04)

(58) Field of Classification Search
CPC B65B 2220/06; B65H 35/02; B65H 2801/27; B41F 13/58; G03G 2215/00814; B02C 18/06; B02C 18/18; B02C 18/22
USPC ..... 270/5.02, 5.03, 21.1, 52.17
See application file for complete search history.

(56) References Cited

U.S. PATENT DOCUMENTS 3,889,939 A * 6/1975 Faltin ..... 270/21.1
4,381,107 A * 4/1983 Armiger ..... 270/52.09
(Continued)

FOREIGN PATENT DOCUMENTS

JP 62044400 A 2/1987
JP 01121199 A 5/1989
WO 2006001370 A1 1/2006

OTHER PUBLICATIONS

Japanese Office Action (and English translation thereof) dated Jan. 20, 2016, issued in counterpart Japanese Application No. 2014-055164.
(Continued)

*Primary Examiner* — Leslie A Nicholson, III
(74) *Attorney, Agent, or Firm* — Holtz, Holtz & Volek PC

(57) ABSTRACT

A post-processing device includes a sheet transporting section that transports one or more sheets, a cutting section that cuts the sheet along a transporting direction of the sheet being transported by the sheet transporting section and a paper piece transporting section that transports a paper piece cut by the cutting section, and a transporting speed of the paper piece transporting section is set lower than a transporting speed of the sheet transporting section.

17 Claims, 13 Drawing Sheets

(51) Int. Cl.

| | |
|---|---|
| ***B41F 13/58*** | (2006.01) |
| ***B02C 18/22*** | (2006.01) |
| ***B02C 18/18*** | (2006.01) |
| ***B02C 18/06*** | (2006.01) |
| ***B26D 7/26*** | (2006.01) |
| ***B41J 11/70*** | (2006.01) |
| *B26D 1/24* | (2006.01) |
| *B26D 7/00* | (2006.01) |

(56) References Cited

U.S. PATENT DOCUMENTS

| | | | | |
|---|---|---|---|---|
| 5,229,827 | A * | 7/1993 | Sato et al. | 399/385 |
| 7,611,133 | B2 * | 11/2009 | Sussmeier et al. | 270/5.03 |
| 7,878,494 | B1 * | 2/2011 | Volkert | B41F 13/54 270/17 |
| 8,162,248 | B2 | 4/2012 | Kuraoka | |
| 8,911,167 | B2 * | 12/2014 | Kanazawa et al. | 400/621 |
| 2007/0023560 | A1 * | 2/2007 | Kodaka | B08B 1/008 242/525 |

OTHER PUBLICATIONS

Chinese Office Action (and English translation thereof) dated Jun. 22, 2016, issued in counterpart Chinese Application No. 201510115376.1.

* cited by examiner

RELATED ART

POST-PROCESSING DEVICE AND IMAGE FORMING SYSTEM

CROSS-REFERENCE TO RELATED APPLICATIONS

The present application claims priority under 35 U.S.C. §119 to Japanese Patent Application No. 2014-055164, filed Mar. 18, 2014. The contents of this application are incorporated herein by reference in their entirety.

BACKGROUND OF THE INVENTION

Field of the Invention

The present invention relates to a post-processing device including a cutting section that cuts part of a sheet and an image forming system including the post-processing device.

Description of the Related Art

When a post-processing device performs post-processing on a sheet on which an image has been formed in an image forming device, there is a case where part of the sheet is cut at a top and a bottom of the sheet so that the size of the sheet is adjusted. In a field of shredders for cutting sheets, by rotating a cutting mechanism other than transportation at a higher speed, it is possible to realize more reliable cutting (see, for example, International Publication No. WO 2006/001370).

However, because the post-processing device uses the sheet after being cut as printed paper, the post-processing device includes a sheet transporting section that transports a sheet and a paper piece transporting section that transports a cut paper piece, which are configured so that the respective transporting sections transport the sheet and the paper piece at the same speed.

However, if the stiffness of the cut sheet is low or if a slit width is small, the shape of the paper piece after being slit is not maintained, which makes the paper piece after being slit proceed in a direction away from the sheet being transported. In this case, because the cut sheet is fed and transported from an oblique direction, a force is further applied in a direction away from the cut sheet. Therefore, a problem arises that action of pulling the paper piece from the cut face occurs, which causes scuffing on the cut face and degrades product quality.

The present invention has been made in view of the above-described circumstances, and at least one of the objects of the present invention is to provide a post-processing device and an image forming system which can perform processing without causing a defect on a cut face when a sheet is cut and transported.

SUMMARY OF THE INVENTION

To achieve at least one of the abovementioned objects, a post-processing device of the present invention has a sheet transporting section that transports one or more sheets, a cutting section that cuts the sheet along a transporting direction of the sheet being transported at the sheet transporting section, and a paper piece transporting section that transports a paper piece cut at the cutting section, and a transporting speed of the paper piece transporting section is set lower than a transporting speed of the sheet transporting section.

In the post-processing device according to the abovementioned aspect, it is preferable that further comprises a control section that controls transportation of the sheet and transportation of the paper piece, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, sets the transporting speed of the paper piece transporting section lower than the transporting speed of the sheet transporting section.

In the post-processing device according to the abovementioned aspect, it is preferable that the control section performs the judgment based on a stiffness of the sheet.

In the post-processing device according to the abovementioned aspect, it is preferable that the control section performs the judgment based on any one or more of a type of the sheet, a grain direction, a thickness and a cut width of the sheet being transported.

In the post-processing device according to the abovementioned aspect, it is preferable that the control section sets a deceleration rate of the transporting speed of the paper piece transporting section to the transporting speed of the sheet transporting section according to a cut width of the sheet and a basis weight of the sheet.

In the post-processing device according to the abovementioned aspect, it is preferable that the control section further sets the deceleration rate based on one or both of a type of the sheet and a grain direction.

In the post-processing device according to the abovementioned aspect, it is preferable that the cutting section is a mechanism for cutting one or both of a top and a bottom of the sheet.

In the post-processing device according to the abovementioned aspect, it is preferable that, by setting a nip pressure of the paper piece transporting section lower than a nip pressure of the sheet transporting section, the transporting speed of the paper piece transporting section is set lower than the transporting speed of the sheet transporting section.

In the post-processing device according to the abovementioned aspect, it is preferable that, by setting a friction coefficient of the paper piece transporting section lower than a friction coefficient of the sheet transporting section, the transporting speed of the paper piece transporting section is set lower than the transporting speed of the sheet transporting section.

To achieve at least one of the abovementioned objects, an image forming system of the present invention has an image forming device that forms an image on a sheet, and a post-processing device including a sheet transporting section that transports one or more sheets, a cutting section that cuts the sheet along a transporting direction of the sheet being transported at the sheet transporting section, and a paper piece transporting section that transports a paper piece cut at the cutting section, and a transporting speed of the paper piece transporting section being set lower than a transporting speed of the sheet transporting section.

In the image forming system according to the abovementioned aspect, it is preferable that further comprises a control section that controls transportation of the sheet and transportation of the paper piece in the post-processing device, and the control section judges whether the sheet being transported by the sheet transporting section runs in parallel with the paper piece cut at the cutting section and being transported by the paper piece transporting section, and, when judging that the paper piece does not run in parallel with the sheet, sets the transporting speed of the paper piece transporting section lower than the transporting speed of the sheet transporting section.

In the image forming system according to the above-mentioned aspect, it is preferable that the control section performs the judgment based on a stiffness of the sheet.

In the image forming system according to the above-mentioned aspect, it is preferable that the control section performs the judgment based on any one or more of a type of the sheet, a grain direction, a thickness and a cut width of the sheet being transported.

In the image forming system according to the above-mentioned aspect, it is preferable that the control section sets a deceleration rate of the transporting speed of the paper piece transporting section to the sheet transporting speed of transporting section according to the cut width of the sheet and a basis weight of the sheet.

In the image forming system according to the above-mentioned aspect, it is preferable that the control section further sets the deceleration rate based on one or both of a type of the sheet and a grain direction.

In the image forming system according to the above-mentioned aspect, it is preferable that, by setting a nip pressure of the paper piece transporting section lower than a nip pressure of the sheet transporting section, the transporting speed of the paper piece transporting section is set lower than the transporting speed of the sheet transporting section.

In the image forming system according to the above-mentioned aspect, it is preferable that, by setting a friction coefficient of the paper piece transporting section lower than a friction coefficient of the sheet transporting section, the transporting speed of the paper piece transporting section is set lower than the transporting speed of the sheet transporting section.

DETAILED DESCRIPTION OF THE PREFERRED EMBODIMENTS

Next, embodiments of the present invention will be described based on the accompanying drawings.

An image forming system 1 including an image forming device 10 and a post-processing device 30 will be described below.

Figure 1:
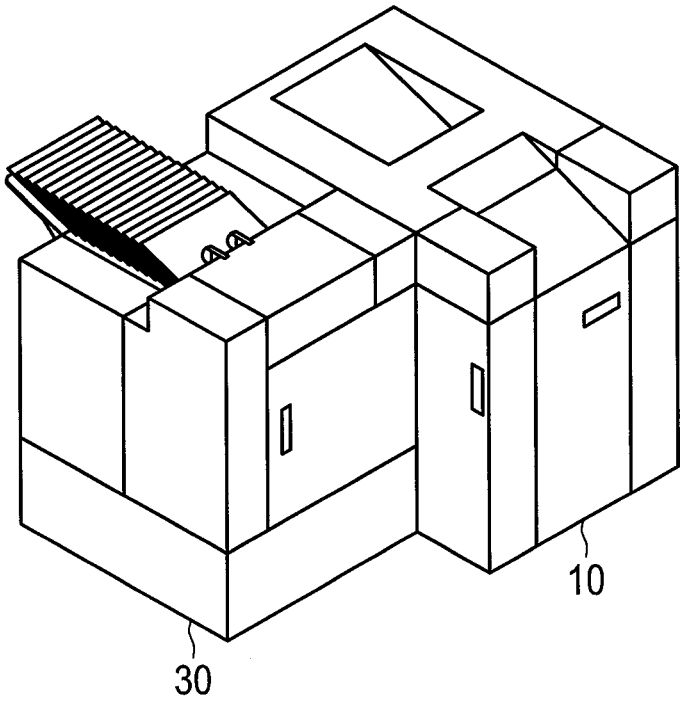
FIG. 1 is a diagram illustrating one example of an external configuration of an image forming system in one embodiment of the present invention.
Figure 2:
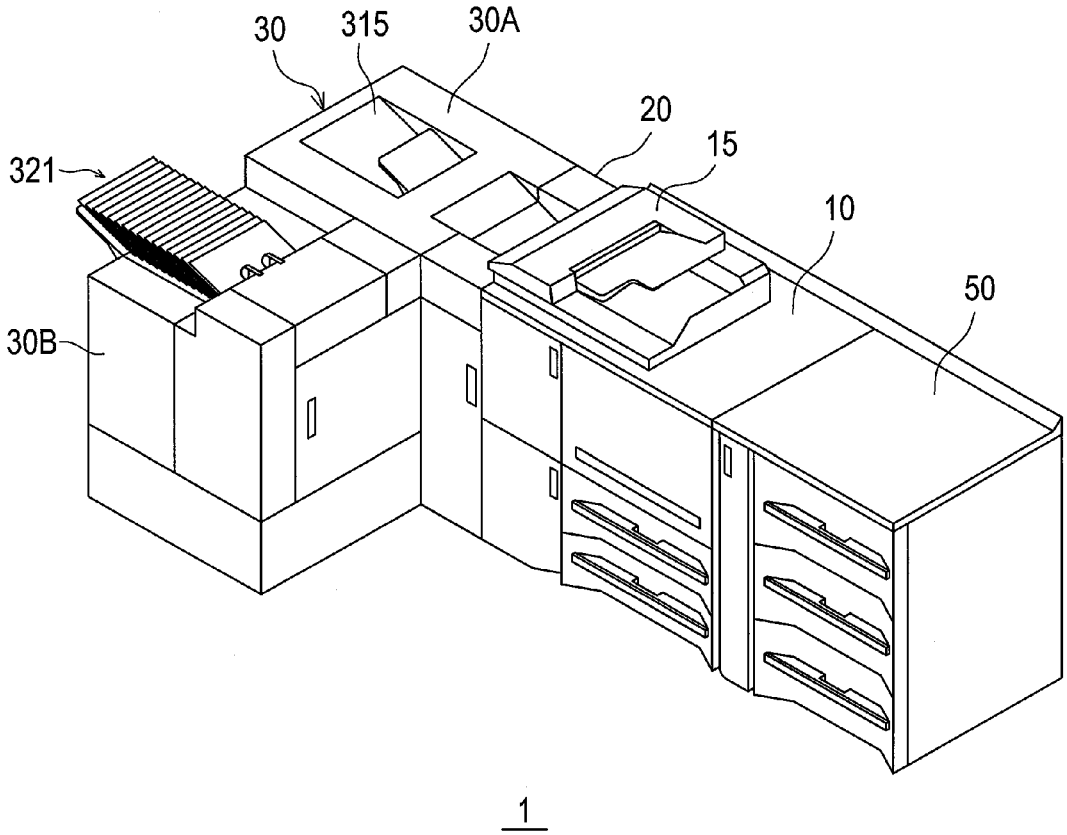
FIG. 2 is a diagram illustrating one example of an external configuration of an image forming system in another embodiment.

In the image forming system illustrated in FIG. 1, the image forming device 10 that forms images and the post-processing device 30 that performs booklet processing of performing saddle stitching bookbinding on sheets on which the images are formed at the image forming device are mechanically and electrically connected. Further, FIG. 2 illustrates a modified example of the image forming system 1 in which a reverse transporting device 20 is disposed between the image forming device 10 and the post-processing device 30, and a large capacity paper feed tray 50 is disposed and connected at an upstream side of the image forming device 10. The post-processing device 30 has a front block 30A and a lateral block 30B.

An outline of a mechanical configuration of the image forming system 1 illustrated in FIG. 2 will be described below with reference to FIG. 3.

In the image forming system 1, the image forming device 10, the reverse transporting device 20 and the post-processing device 30 are continuously connected.

The connection configuration of the image forming system of the present invention is not limited to this. Further, the post-processing device of the present invention can be used in a stand-alone manner, as well as being directly or indirectly connected to the image forming device.

Further, it is also possible to employ a configuration in which the post-processing device is incorporated in the image forming device.

In the image forming device 10, an automatic document feeder (ADF) 15 which configures part of a document reading section is provided at an upper side, and an image of a document fed by the automatic document feeder (ADF) 15 can be read at a scanner section which is not illustrated. It should be noted that the document can be also read on a platen glass which is not illustrated.

Further, at the upper side of the image forming device body 10A of the image forming device 10, an LCD 14 is provided at a portion where the platen glass is not provided. The LCD 14 which is configured with a touch panel, can receive operation by an operator and can display information. In the LCD 14, an operating section is also used as a display section. It should be noted that the operating section can be configured with a mouse, a tablet, and the like, separately from the display section. Further, the LCD 14 can be configured to be able to move.

At the lower side of the image forming device 10, a plurality of paper feed trays 12 (two stages in the drawing) are disposed so as to be able to feed sheets.

Within the image forming device 10, a transporting path 13 which transports a sheet fed from any of the paper feed trays 12 is provided, and an image forming section 103 is provided in the course of the transporting path within the image forming device 10. The image forming section 103 has a photoreceptor 11A, and a charger, an LD, a developer and a transferring section which are disposed around the photoreceptor 11 and which are not illustrated, and a fixer 16 is disposed in the transporting path 13 at the downstream side of the photoreceptor 11A.

At the downstream side of the fixer 16, the transporting path extends and is connected to a transporting path 21 of the reverse transporting device 20.

In the image forming section 103, a surface of the photoreceptor 11A is uniformly charged by the charger before an image is written, and the photoreceptor 11A whose surface is uniformly charged is irradiated with a semiconductor laser by the LD, thereby an electrostatic latent image is formed on the photoreceptor 11A. The developer develops the electrostatic latent image formed on the photoreceptor 11A by the LD using a toner member. A toner image is formed on the photoreceptor 11A by the development processing. The transferring section transfers the toner image of the photoreceptor 11A on the sheet transported from the paper feed tray 12. The sheet on which the toner image is transferred is separated from the photoreceptor 11A and transported to the fixer 16. The toner member left on the photoreceptor 11A is removed by a cleaning section which is not illustrated.

The fixer 16 fixes the toner image transferred on a front side of the sheet as an output image by heating the transported sheet. The sheet subjected to fixing processing is transported to the reverse transporting device 20 as is by the transporting path 13 or returned to the upstream side of the image forming section 103 after the front and back sides of the sheet are reversed, and an image is formed on the back side of the reversed sheet by the image forming section 103, so that printing can be performed on the both sides.

In the reverse transporting device 20, the transporting path 21 is provided as mentioned above, and a reverse transporting path 22 is provided in the course of the transporting path 21, where the sheet transported through the transporting path 21 can be reversed and transported. When a sheet is transported without being reversed, the sheet does not pass through the reverse transporting path 22 and can be transported to the downstream side through the transporting path 21. The transporting path 21 is connected to the transporting path 31 of the post-processing device 30 at the downstream side.

In the post-processing device 30, predetermined post-processing such as saddle stitching stapling and paper ejection are performed.

In the front block 30A of the post-processing device 30, a reverse and superimposition transporting path 32 having a matching function in the course of the transporting path 31 is provided, and in the reverse and superimposition transporting path 32, a creaser that performs creasing on the sheet is provided. At the downstream side thereof, a cutting section 34 that cuts the sheet and a folding unit 35 that performs folding processing on the sheet are disposed in this order. In this embodiment, the cutting section 34 cuts a top and a bottom of the sheet.

Figure 3:
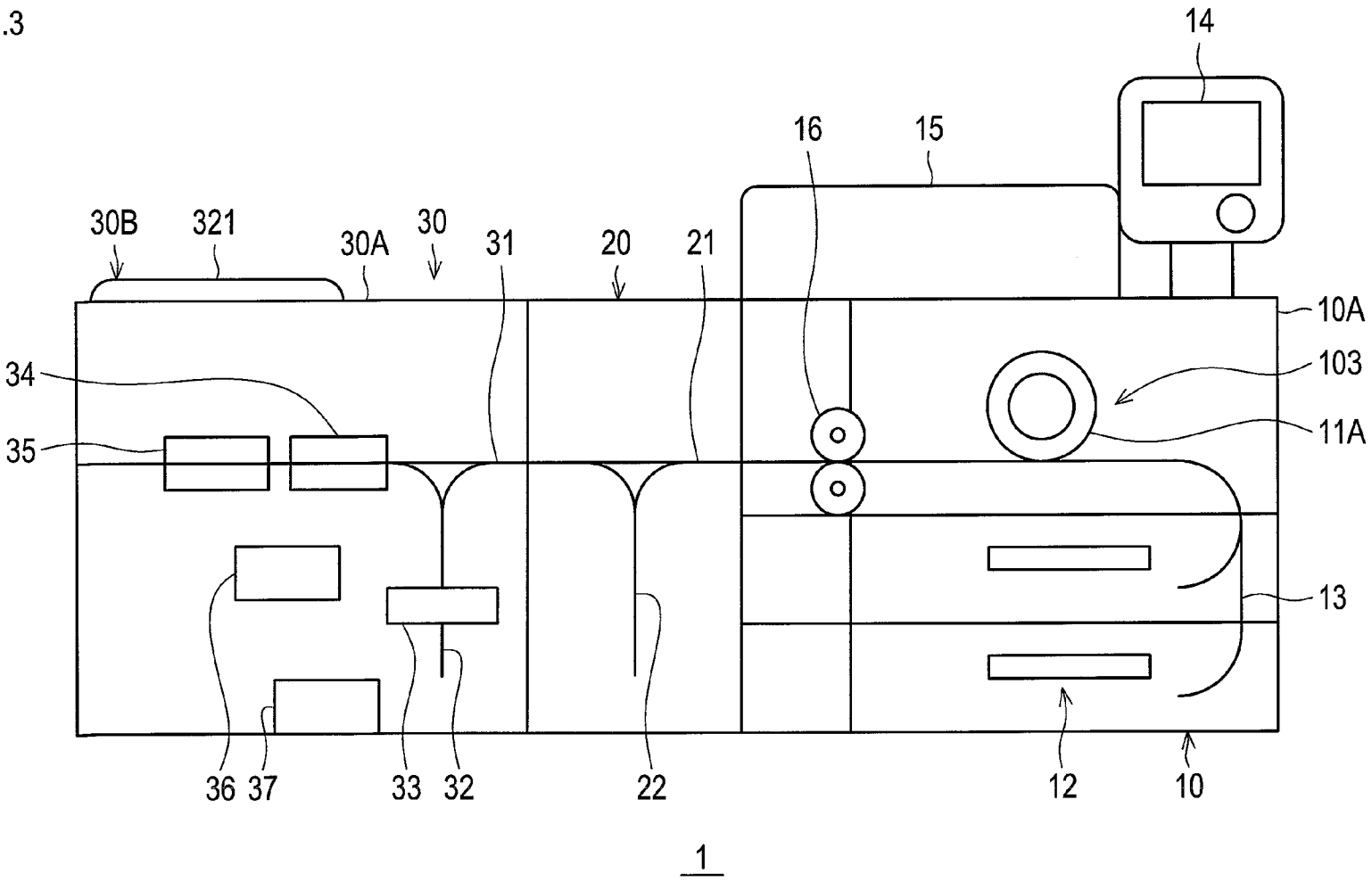
FIG. 3 is a diagram illustrating a schematic configuration of the image forming system.

Further, in the post-processing device 30, the lateral block 30B is provided at the lateral side of the front block 30A, and in the lateral block 30B, a saddle stitch stapling section which is not illustrated in FIG. 3, a square hold 36 which corners a sheet, and a cutting unit 37 that cuts fore-edges are provided. Further, in the lateral block 30B, a booklet placement section 321 on which a booklet after being subjected to the post-processing is placed is provided.

Figure 4:
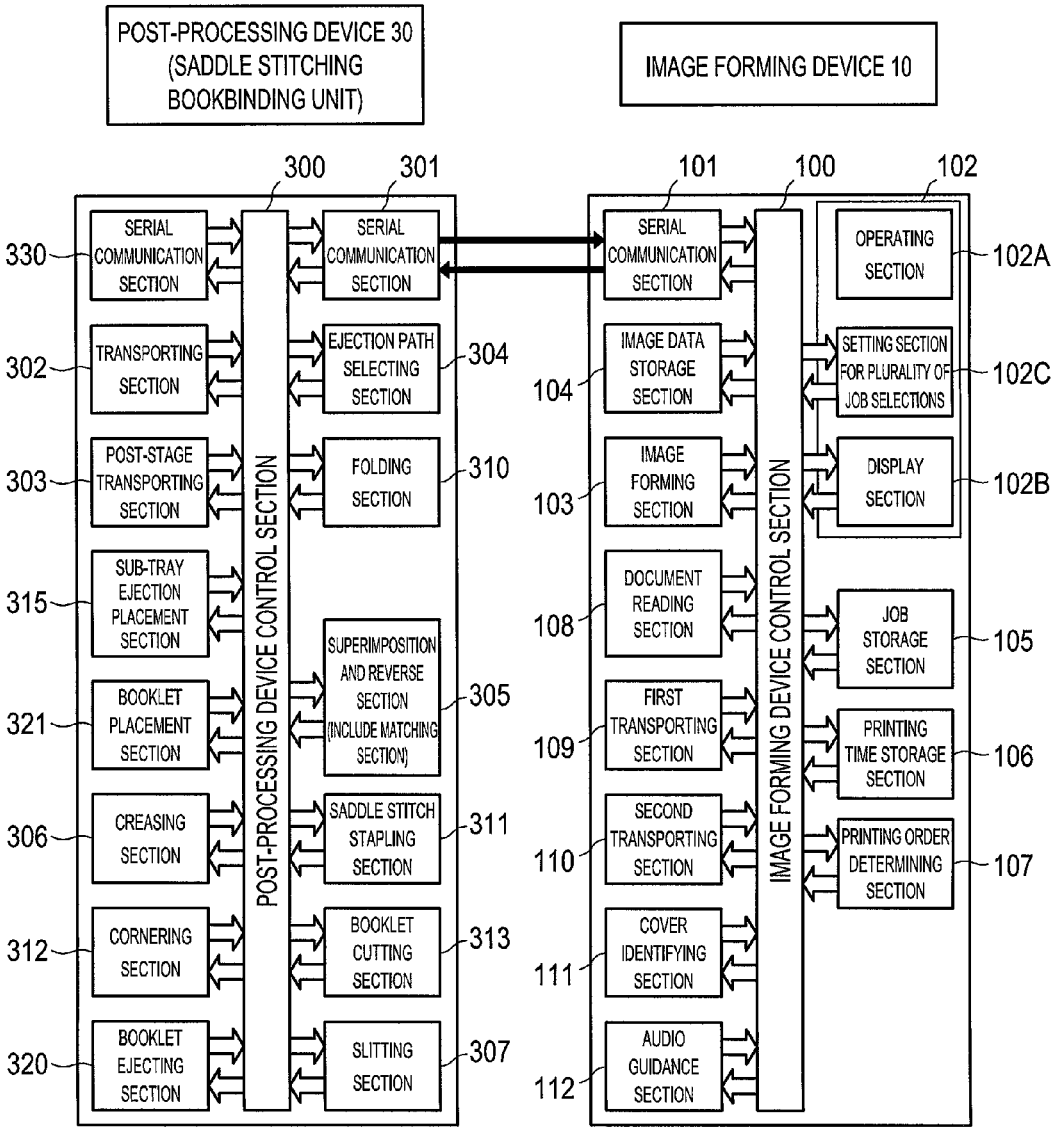
FIG. 4 is a block diagram of the image forming system.

Next, part of the control blocks of the image forming system 1 will be described based on FIG. 4. It should be noted that, in the following description, the explanation of the reverse transporting device 20 and the large-capacity paper feed tray 50 will be omitted.

The image forming device 10 includes an image forming device control section 100, a serial communication section 101, an operation display section 102, an image forming section 103, an image data storage section 104, a JOB storage section 105, a printing time storage section 106, a printing order determining section 107, a document reading section 108, a first transporting section 109, a second transporting section 110, a cover identifying section 111 and an audio guidance section 112.

The image forming device control section 100 that controls the image forming device 10 has a CPU (Central Processing Unit), a RAM (Random Access Memory), a ROM (Read Only Memory) and a non-volatile memory.

The image forming device control section 100 executes various processing by the operation of the CPU based on a program read out from the ROM and decompressed at the RAM and setting data read out from the non-volatile memory. Further, the image forming device control section 100 controls the reverse transporting device 20 and the post-processing device 30 in the image forming system 1 and configures the control section of the present invention.

Further, the non-volatile memory includes setting data for controlling the post-processing device 30 and has control data for a cutting section which will be described later.

The serial communication section 101 which is controlled by the image forming device control section 100, performs serial communication with a serial communication section 301 of the post-processing device 30 via the reverse transporting device 20.

The operation display section 102 has an operating section 102A, a display section 102B such as an LCD (Liquid Crystal Display), and a setting section for plurality of JOB selections 102C. It should be noted that, in this embodiment, the operating section 102A and the display section 102B are configured with an LCD touch panel 14. The setting section for plurality of JOB selections 102C allow selection and execution of a necessary JOB out of a plurality of listed JOBs, and allow display of a list of JOBs and operation and input for selecting a JOB which is to be executed through the operating section 102A and the display section 102B.

The operation display section 102 which is controlled by the image forming device control section 100, displays various operation switches, information relating to post-processing, or the like, at the display section 102B, acquires operation information including types of various processing functions from sheet feeding until sheet ejection, such as reverse processing, saddle stitch processing and both-side printing, sheet sizes, and the like, by a touch input from a user via the operating section 102A, and outputs the information to the image forming device control section 100.

The image forming section 103 which is controlled by the image forming device control section 100, forms an image on a sheet based on document image information input from the document reading section 108 or image information of a print job input from external equipment (not illustrated) such as a PC (Personal Computer) connected to the image forming device 10 via a network.

The image forming section 103 is, for example, an electrophotographic type image forming section. In the image forming section 103 where a charging section, an exposing section, a developing section, a transferring section, a separating section and a cleaning section (which are not illustrated) are disposed around a drum-like photoreceptor 11A, charging, exposure and development are performed by these electrophotographic process devices, a toner image is formed on the photoreceptor, the image is transferred to the sheet, so that the image is formed. Image data used for image formation is stored in an image data storage section. The printing time is recorded in the printing time storage section 106.

The JOB data is stored in the JOB storage section 105 and read out appropriately. The printing order determining section 107 which determines an order of printing JOBs, can determine a printing order of the plurality of JOBs as reserved JOBs and can record the printing order in the JOB storage section 105, or the like.

The document reading section 108 which is controlled by the image forming device control section 100, reads an image of the document using a CCD (Charge Coupled Device), or the like, and outputs document image information to the image forming device control section 100. In the image forming device control section 100, the job data is stored in the JOB storage section 105, and the image is formed by temporarily storing image data in the image data storage section 104 when printing is performed.

The first transporting section 109 is a transporting path such as a transporting roller, which is controlled by the image forming device control section 100, and which transports a sheet fed from the paper feed tray 12 via the image forming section 103 and ejects the sheet to the reverse transporting device 20.

The second transporting section 110 is a transporting path such as a transporting roller, which is controlled by the image forming device control section 100 and which, upon both-side printing, transports a sheet on which an image is formed on one side by the image forming section 103 via the reversing mechanism (not illustrated), and transports the sheet to the image forming section 103 again.

The transporting path 13 includes a first transporting section 109 and a second transporting section 110.

The cover identifying section 111 which identifies whether the fed sheet is a cover, identifies a printed page which becomes a cover of a booklet, or the like, from the image printed by the image forming section 103 (for example, a cover identifier printed on the sheet) or the image data included in the printing job. This cover identification can be executed using a publicly known method.

The audio guidance section 112 which facilitates operation by using audio guidance in predetermined operation, can be activated through an operation button provided at the operation display section 102 or a button for audio guidance provided at a position other than the operation display section 102.

Next, the post-processing device 30 will be described.

The post-processing device 30 includes a post-processing device control section 300 that controls the whole of the post-processing device 30, the serial communication section 301, a serial communication section 330, a transporting section 302, a post-stage transporting section 303, an ejection path selecting section 304, a superimposition and reverse section 305 having a matching function (matching section), a creasing section 306, a slitting section 307, a folding section 310, a saddle stitch stapling section 311, a cornering section 312, a booklet cutting section 313, a sub-tray ejection placement section 315, a booklet ejecting section 320 and a booklet placement section 321.

As mentioned above, the serial communication section 301 performs serial communication with the serial communication section 101 of the image forming device 10, and the serial communication section 330 performs serial communication with a device to be connected in the future at the following stage of the post-processing device 30.

The transporting section 302 includes a transporting roller, or the like, which transports a sheet transported to the post-processing device 30 from the front block 30*a* to the lateral block 30B or to the sub-tray ejection placement section 315.

When another device is connected at the following stage of the post-processing device 30, the post-stage transporting section 303 is a transporting path part such as a transporting roller, for transporting a sheet from the post-processing device 30 to the other device. The transporting path 31 is included in the transporting section 302.

The ejection path selecting section 304 which is controlled by the post-processing device control section 300, selects one of the transporting section 302, the post-stage transporting section 303 and the sub-tray ejection placement section 315 to eject the sheet.

The superimposition and reverse section 305 which includes the reverse and superimposition transporting path 32, is controlled by the post-processing device control section 300 and is configured with a transporting path, a transporting roller, or the like. The superimposition and reverse section 305 has a matching section capable of reversing and superimposing sheets to make a sheet bundle.

The creasing section 306 which includes a creaser 33 that creases a sheet, is controlled by the post-processing device control section 300 and performs creasing operation on a sheet according to processing to be performed in the post-processing.

The slitting section 307 which includes a cutting section 34 that cuts a sheet at a top and a bottom, is controlled by the post-processing device control section 300 and cuts a sheet at a top and a bottom according to processing to be performed in the post-processing.

The folding section 310 which is included in the folding unit 35, is controlled by the post-processing device control section 300 and performs folding processing on the sheet.

The saddle stitch stapling section 311 which is controlled by the post-processing device control section 300 and which performs stapling processing in which the sheet bundle is bound by inserting binding needles at two points or four points where the sheet is divided at the center in the width direction, is included in the lateral block 30B.

The cornering section 312 which includes a square hold 36 that corners a back part of a sheet, is controlled by the post-processing device control section 300 and performs square back processing for flattening a back folding section of the sheet bundle at which a folding line is formed. The cornering section 312 is included in the lateral block 30B.

The booklet cutting section 313 which includes a cutting unit 37 equipped with a cutting blade, or the like, is controlled by the post-processing device control section 300 and cuts fore-edges for aligning fore-edges of the sheets of the sheet bundle which has been subjected to center folding processing and stapling processing by the folding section 310 and the saddle stitching stapling section 311 and has been formed as a booklet. The booklet cutting section 313 is included in the lateral block 30B.

The above-described superimposition and reverse section 305, creasing section 306, slitting section 307, folding section 310, saddle stitch stapling section 311, cornering section 312 and booklet cutting section 313 configure the post-processing section of the present invention. It should be noted that the feature of the post-processing section is not particularly limited in the present invention, and any post-processing section is possible if it can perform booklet processing.

The booklet ejecting section 320 ejects the saddle stitched sheets to the booklet placement section 321.

Figure 5:
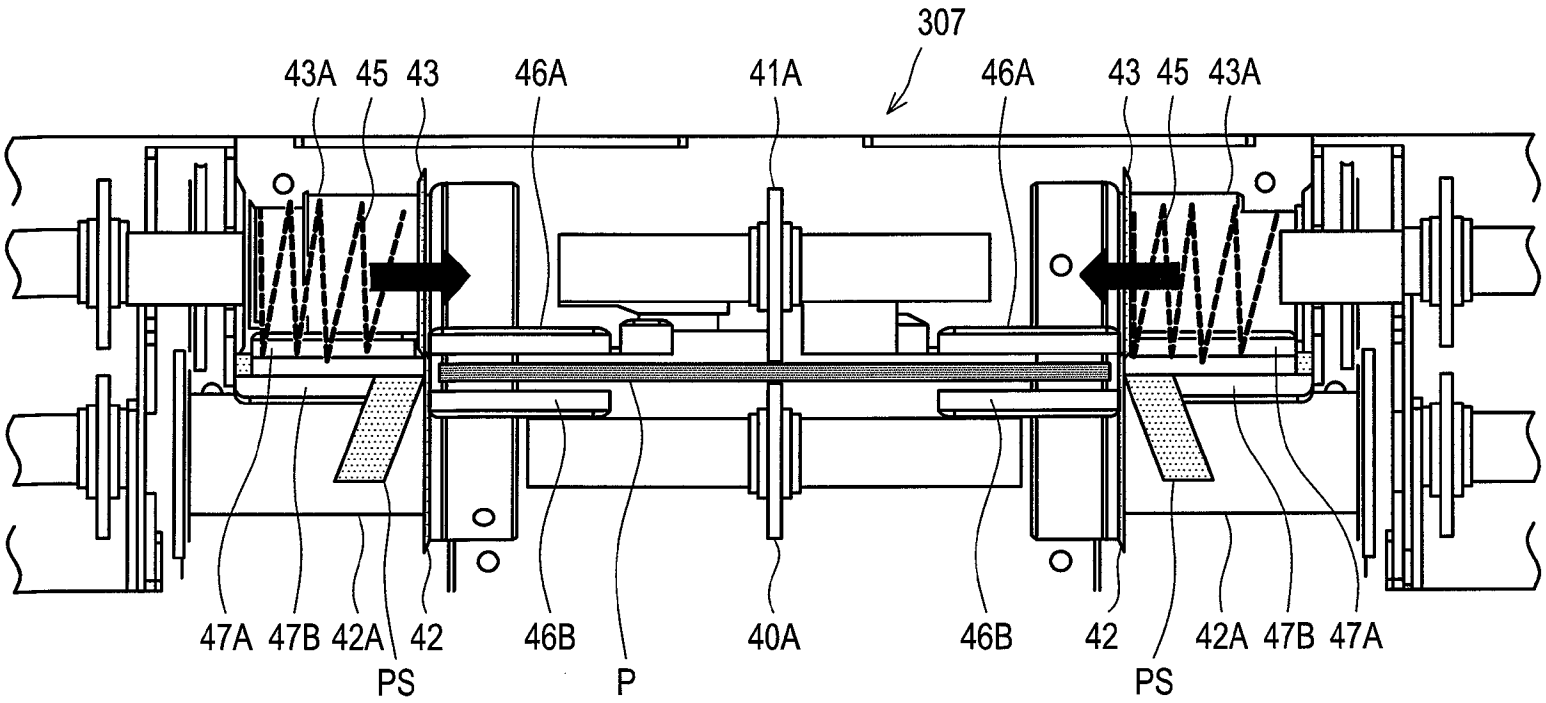
FIG. 5 is a diagram of a slitting section seen from the downstream side.
Figure 6:
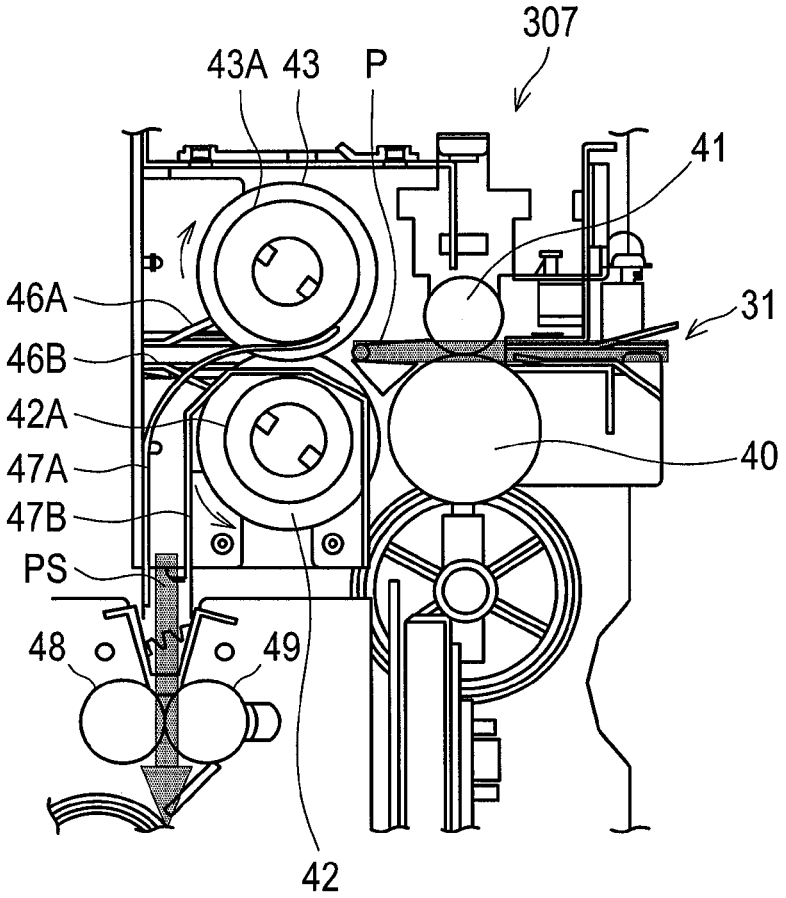
FIG. 6 is a diagram of the slitting section seen from the lateral side.
Figure 7:
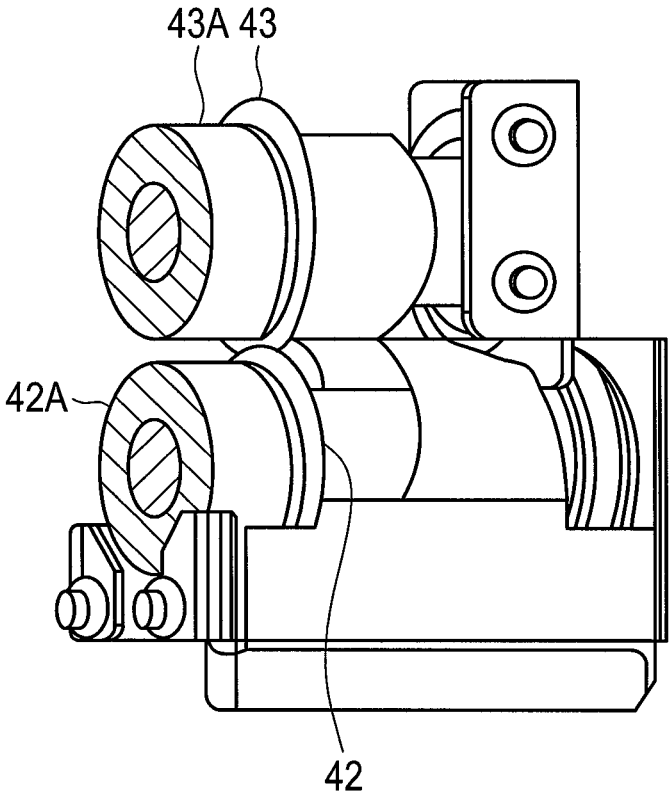
FIG. 7 is a perspective view illustrating an end portion of a width direction of the slitting section.

A detailed configuration of the slitting section 307 will be described next based on FIG. 5 to FIG. 7. FIG. 6 is a view of the slitting section 307 seen from the lateral side in the sheet transporting direction. FIG. 5 is a view of the slitting section 307 seen from the posterior side in the sheet transporting direction, where a sheet is transported from the back side in the drawing toward the front side in the drawing. FIG. 7 is a view illustrating one end side in the sheet width direction in the cutting section 34.

The transporting path 31 which has transporting rollers 40, 41, one of which is rotated as a drive roller and the other is rotated as a driven roller, transports a sheet P at a predetermined speed. In the embodiment, the transporting path 31, the transporting roller 40 and the transporting roller 41 configure a sheet transporting section of the present invention which transports a sheet. The transporting speed (linear velocity) of the transporting rollers 40, 41 is determined by the image forming device control section 100, and a command of the transporting speed is conveyed to the post-processing device control section 300 which controls transportation. Further, the transportation by the transporting rollers 40, 41 can be determined and controlled by the post-processing device control section 300, in which case the post-processing device control section 300 serves as the control section of the present invention.

In the vicinity at the downstream side in the transporting direction of the transporting rollers 40, 41, an upper sheet pressing roller 41A and a lower sheet pressing roller 40A which press a sheet from an upper side and a lower side, and lower blades 42, 42 and upper blades 43, 43 positioned at the both sides of the sheet width direction are disposed. The lower blades 42, 42 are rotationally driven by a drive rotational shaft 42A, and the upper blades 43, 43 are rotationally driven by drive rotational shafts 43A, 43A.

The lower blades 42, 42 and the upper blades 43, 43 can change a width of a paper piece (slit width) in the horizontal direction in the width direction of the sheet by changing the position in the width direction. It should be noted that the lower blades 42, 42 and the upper blades 43, 43 are positioned at height such that an outer circumferential edge at the lower side of the upper blades 43, 43 slightly overlaps with an outer circumferential edge at the upper side of the lower blades 42, 42, and the upper blades 43, 43 are respectively positioned outside the lower blades 42, 42.

When the sheet is cut, the upper blades 43, 43 are pressed inwardly by a pressure applied by a pressing member such as a spring coil, and an inner face of the circumference of the upper blades 43, 43 substantially contacts an outer face of the circumference of the lower blades 42, 42. In this state, the lower blades 42, 42 and the upper blades 43, 43 rotate in the sheet transporting direction, and thus the sheet transported from the sheet transporting section is cut. In the embodiment, the upper blades 43, 43, the drive rotational shafts 43A, 43A, the lower blades 42, 42, the drove rotational shafts 42A, 42A and the pressing member 45 configure the cutting section of the present invention.

At the downstream side of the positions of the upper blade 43 and the lower blade 42 in the sheet transporting direction, an upper guide 46A and a lower guide 46B extend toward the downstream side along the sheet transporting direction so as to put the transporting path 31 between the upper guide 46A and the lower guide 46B. The sheet P whose paper piece is cut by the upper blade 43 and the lower blade 42 moves through the transporting path 31 between the upper guide 46A and the lower guide 46B while being transported by the transporting rollers 40, 41.

Meanwhile, the paper piece PS cut by the upper blade 43 and the lower blade 42 passes between an upper oblique guide 47A and a lower oblique guide 47B which extend downward in the downstream direction from the upper blade 43 and the lower blade 42 and is ejected downward by slit scrap transporting rollers 48, 49. The slit scrap transporting rollers 48, 49 are rotationally driven so as to move the paper piece PS to the lower side. Below the slit scrap transporting rollers 48, 49, a slit scrap storage box, or the like, which is not illustrated is disposed to store slit scraps. The transporting speed (linear velocity) of the slit scrap transporting rollers 48, 49 is determined by the image forming device control section 100, and a command of the transporting speed is conveyed to the post-processing device control section 300 which controls transportation. Further, the transporting speed of the paper piece can be determined and controlled by the post-processing device control section 300. In this case, the post-processing device control section 300 serves as the control section of the present invention. Further, the slit scrap transporting rollers 48, 49 corresponds to a paper piece transporting section of the present invention.

It should be noted that the transporting speed (linear velocity) of the above-described transporting rollers 40, 41 and the transporting speed (linear velocity) of the slit scrap transporting rollers 48, 49 are typically set at the same speed.

A state where the sheet is cut described above will be described based on a plane view of FIG. 8.

An edge side in the sheet width direction of the sheet P being transported by the transporting rollers 40, 41 is cut along a transporting direction by the upper blade 43 and the lower blade 42 at a predetermined slit width as described above. In this embodiment, the paper piece PS is cut in parallel with the transporting direction. It should be noted that while this drawing illustrates a state where the sheet is cut at only one side in the width direction, it is also possible to cut the sheet at the both sides in the sheet width direction. The paper piece PS is guided by the upper oblique guide 47A and the lower oblique guide 47B so as to be reliably transported in a direction of the slit scrap storage box, and is transported in the direction of the slit scrap storage box, or the like, by the slit scrap transporting rollers 48, 49. In FIG. 6, the paper piece PS and a moving direction are illustrated in a simulated manner.

Figure 8:
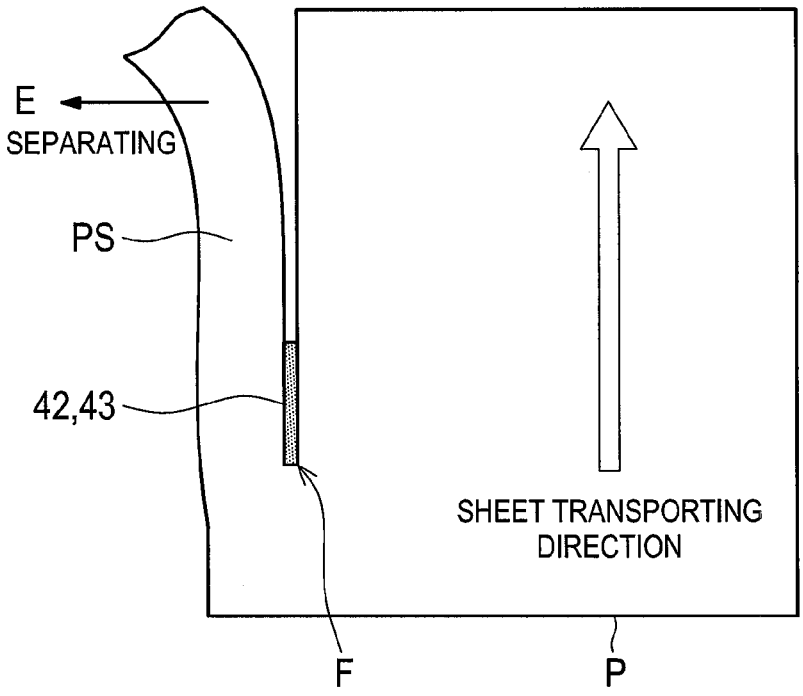
FIG. 8 is a diagram illustrating a state of a sheet being transported through the slitting section.

It should be noted that if the stiffness of the paper piece PS side is small, as illustrated in FIG. 8, when the sheet P is cut, a force E which expands in a direction away from the sheet P is applied on the paper piece PS, and the cut paper piece PS is not transported in parallel with the remaining portion after the paper P is cut and is likely to be transported obliquely. The paper piece PS transported obliquely from the transporting rollers 40, 41 to the slit scrap transporting rollers 48, 49 are held in an oblique direction between the slit scrap transporting rollers 48, 49, and, as a result, a force is further applied at a supporting point F of the cut slit, which makes it more likely to cause scuffing at the supporting point F of the slit. The scuffing continues as the sheet is transported.

In the present embodiment, the transporting speed of the slit scrap is set lower than the transporting speed of the sheet so that flexure of the sheet is caused between the paper piece PS and the slit scrap transporting rollers 48, 49 due to a difference in the speeds, and the force applied at the supporting point of the slit is weaken by the flexure, so as to prevent occurrence of scuffing.

Figure 9A:
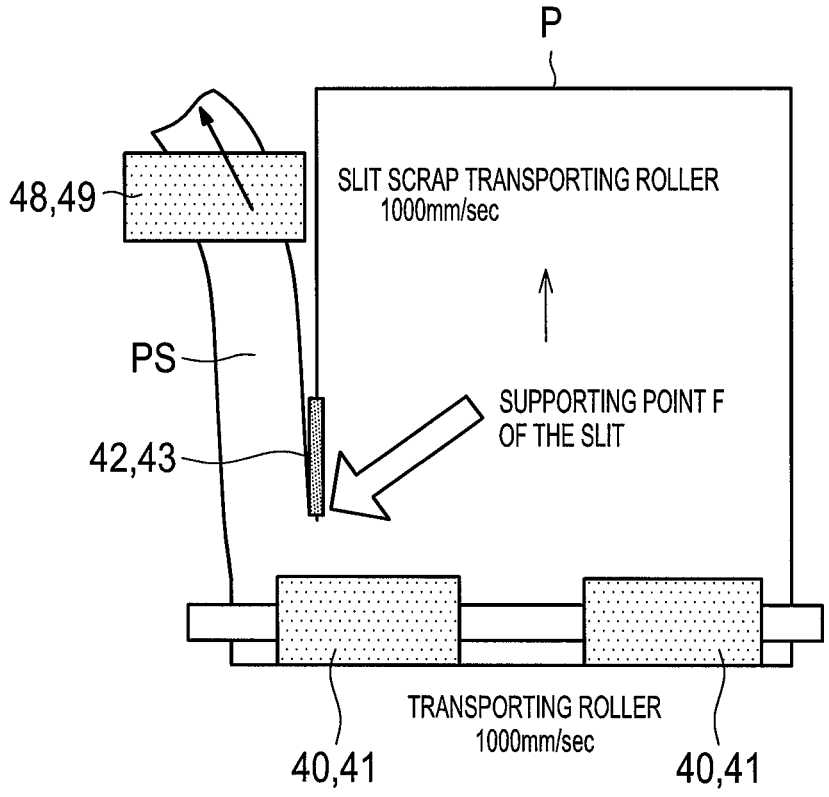
FIG. 9A is a diagram illustrating a state of a sheet being transported through a slitting section in the related art.
Figure 9B:
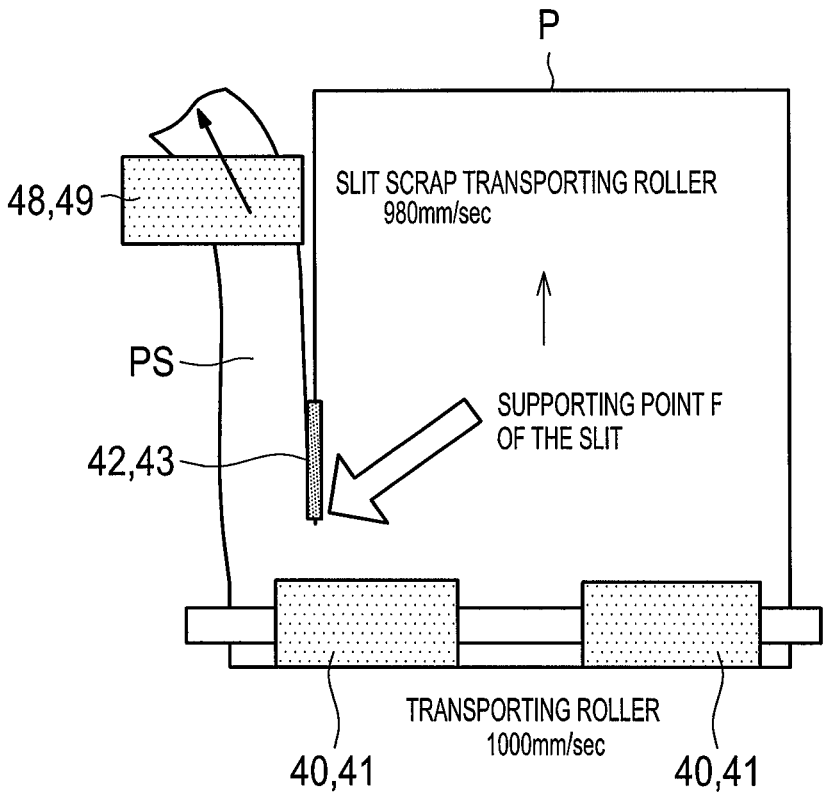
FIG. 9B is a diagram illustrating a state of a sheet being transported through the slitting section in the embodiment.

FIG. 9A and FIG. 9B illustrate states where the sheet is transported according to a difference between the transporting speed of the sheet and the transporting speed of the slit scrap.

FIG. 9A illustrates a related art technique in which the transporting speed (linear velocity) of the transporting rollers 40, 41 is set at 1000 mm/second and the transporting speed (linear velocity) of the slit scrap transporting rollers 48, 49 is set 1000 mm/second, that is, the same speeds are set for the both speeds.

In this state, when the stiffness of the sheet is small, a force is applied in a direction that the paper piece PS cut by the upper blade and the lower blade separates from the remaining sheet P, which makes it more likely to cause scuffing at the supporting point F of the slit.

FIG. 9B illustrates a state where the transporting speed (linear velocity) of the transporting rollers 40, 41 is set at 1000 mm/second, and the transporting speed (linear velocity) of the slit scrap transporting rollers 48, 49 is set at 980 mm/second, that is the transporting speed of the slit scrap transporting rollers 48, is set lower than (decelerated compared to) the transporting speed of the transporting rollers 40, 41. By this means, flexure of the sheet is caused in the vicinity of the supporting point F of the slit, which prevents occurrence of scuffing.

Further, by setting a nip pressure of the slit scrap transporting rollers 48, 49 lower than that of the transporting rollers 40, 41 so as to cause a difference between a sheet transporting force and a slit scrap transporting force, as illustrated in FIG. 9B, it is possible to make a force less likely to be applied in a direction that the paper piece PS cut by the upper blade and the lower blade separates from the remaining sheet P, and it is possible to make it less likely to cause scuffing at the supporting point F of the slit.

Further, in a similar manner, by setting a friction force of the slit scrap transporting rollers 48, 49 lower than that of the transporting rollers 40, 41 so as to cause a difference between the sheet transporting force and the slit scrap transporting force, as illustrated in FIG. 9B, it is possible to make a force less likely to be applied in a direction that the paper piece PS cut by the upper blade and the lower blade separates from the remaining sheet P, and it is possible to make it less likely to cause scuffing at the supporting point F of the slit.

Procedure for setting the paper piece transporting speed will be described below based on the flowcharts in FIG. 10 to FIG. 12.

Figure 10:
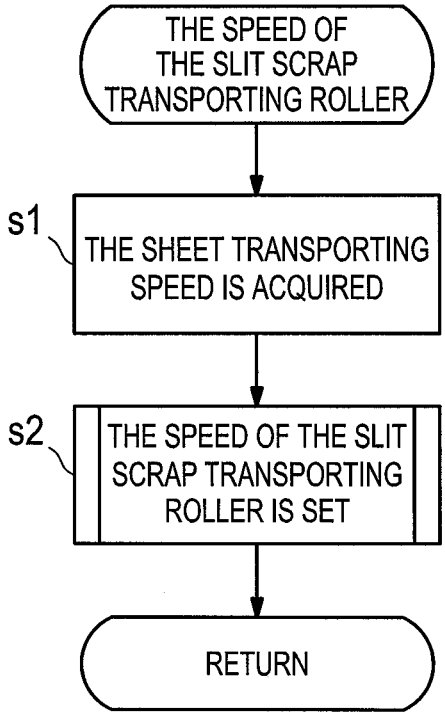
FIG. 10 is a flowchart illustrating procedure for setting a transporting speed of a paper piece.

When the paper piece transporting speed is set lower than the transporting speed of the sheet, as illustrated in FIG. 10, the sheet transporting speed is acquired (step s1), and the speed of the slit scrap transporting roller is set according to the acquired sheet transporting speed (step s2). It should be noted that the following procedure is executed by the control of the image forming device control section. Further, when control is performed by the post-processing device, the following procedure is executed by the control of the post-processing device control section.

Table 1 indicates a result of evaluation of occurrence of scuffing, and the like, when the speed of the slit scrap transporting roller is changed to the sheet transporting speed (1000 mm/second). The width of the slit paper scrap at this time is set at 5 mm. In the evaluation, a case where scuffing, curve, cut curve has not occurred is evaluated as good. A case where any defect has occurred is evaluated as fair or poor.

While the effect of prevention of scuffing, or the like, by a deceleration rate varies depending on the types of a sheet, the deceleration generally provides favorable results within a predetermined range of the deceleration rate. However, in a sheet with a small basis weight where scuffing is more likely to occur, it is possible to provide remarkable effects by decelerating transportation of the paper piece. Further, it is clarified that when the deceleration rate is made too high, curve or cut curve of a sheet occurs.

TABLE 1

| Transporting speed of the slit scrap (the ratio of book body linear velocity) | SHEET NPI High Quality SRA3 81.4 gsm | Joyboree A3 310 gsm | Kinmari V A3 52.3 gsm |
|---|---|---|---|
| 1017 mm/s (+1.7%) | x causing about 5% of scuffing | ○ | x causing scuffing |
| 1000 mm/s (0%) | x causing about 5% of scuffing | ○ | x causing scuffing |
| 990 mm/s (−1%) | ○ | ○ | x causing scuffing |
| 980 mm/s (−2%) | ○ | ○ | ○ |
| 970 mm/s (−3%) | ○ | — | ○ |
| 960 mm/s (−4%) | ○ | ○ | x curve |
| 950 mm/s (−5%) | Δ cut curve: 0.5 mm | — | x curve |
| 900 mm/s (−10%) | x cut curve: 1 mm or more | — | x curve |

The paper piece transporting speed can be determined without regard to stiffness of the sheet.

Figure 11:
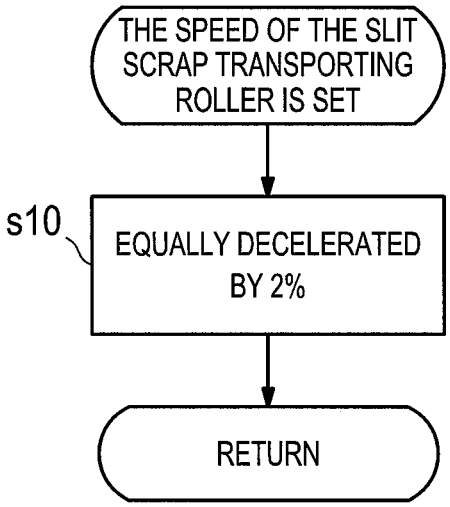
FIG. 11 is a flowchart illustrating one example of a method for setting the transporting speed of a paper piece.

When the speed of the slit scrap transporting roller is set by acquiring the sheet transporting speed in the procedure of FIG. 10, it is possible to set the paper piece transporting speed according to the procedure of FIG. 11. The following procedure is executed by the control of the image forming device control section. Further, when control is performed at the post-processing device, the following procedure is executed by the control of the post-processing device control section.

That is, in the flow of FIG. 11, the paper piece transporting speed is set so that the acquired sheet transporting speed is equally decelerated by 2% (step s10).

Further, the deceleration rate of the paper piece transporting speed can be determined based on the stiffness of the sheet. Because the stiffness of the sheet is influenced by the types of the sheet, thickness, a grain direction and a slit width, the paper piece transporting speed can be set while these are taken into account. The following procedure is executed by the control of the image forming device control section. Further, when control is performed by the post-processing device, the following procedure is executed by the control of the post-processing device control section.

Figure 12:
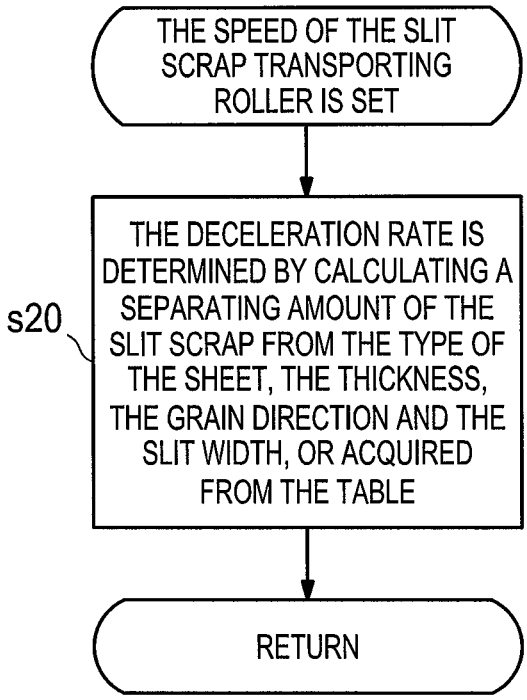
FIG. 12 is a flowchart illustrating one example of a method for setting the transporting speed of a paper piece.

In FIG. 12, when the paper piece transporting speed is set, the deceleration rate is determined by calculating a separating amount of the slit scrap (paper piece) from the type of the sheet, the thickness, the grain direction and the slit width of the sheet to be cut, or acquired from the table (step s20).

Table 2 indicates a table for determining the paper piece transporting speed based on the basis weight and the slit width of the normal sheet. According to this table, the deceleration rate is set smaller for a larger basis weight of the sheet, and the deceleration rate is set larger for a smaller slit width. The table can be prepared for each type of the sheet.

Table 3 indicates a table for determining the paper piece transporting speed based on the basis weight of the sheet and the slit width when long grain is designated as the grain direction of the sheet. According to this table, the deceleration rate is set smaller for a larger basis weight of the sheet, and the deceleration rate is set larger for a smaller slit width. Because the stiffness of the sheet of the long grain is greater than that of the normal sheet, the deceleration rate is set smaller than that in Table 2 overall.

Table 4 indicates a table for determining the paper piece transporting speed based on the basis weight of the sheet and the slit width when a glossy sheet is designated as the type of the sheet. According to this table, the deceleration rate is set smaller for a larger basis weight of the sheet, and the deceleration rate is set larger for a smaller slit width. Because the movement of the slit scrap is different from that of the normal sheet though the basis weight of the glossy sheet is the same, it is necessary to further decelerate the transporting speed compared to a case where the normal sheet is used even if the basis weight is increased.

TABLE 2

(Normal sheet is used)

| The deceleration rate of the slit scrap transporting roller speed(%) | | Basis Weight(gsm) ~50 | 50~62 | 62~75 | 75~92 | 92~136 | 136~163 | 163~217 | 217~ |
|---|---|---|---|---|---|---|---|---|---|
| The width of the slit paper scrap (mm) | ~5 | −2.0 | −2.0 | −1.5 | −1.0 | −1.0 | −1.0 | −0.5 | 0.0 |
| | 5~10 | −2.0 | −2.0 | −1.5 | −1.0 | −1.0 | −0.5 | 0.0 | 0.0 |
| | 10~15 | −1.5 | −1.5 | −1.0 | −1.0 | 0.0 | 0.0 | 0.0 | 0.0 |
| | 15~20 | −1.5 | −1.0 | −1.0 | −0.5 | 0.0 | 0.0 | 0.0 | 0.0 |
| | 20~ | 0.0 | 0.0 | 0.0 | 0.0 | 0.0 | 0.0 | 0.0 | 0.0 |

TABLE 3

(A long grain sheet is designated as the type of the sheet)

| The deceleration rate of the slit scrap transporting roller speed (%) | | Basis Weight(gsm) ~50 | 50~62 | 62~75 | 75~92 | 92~136 | 136~163 | 163~ | 217~ |
|---|---|---|---|---|---|---|---|---|---|
| The width of the slit paper scrap (mm) | ~5 | −1.5 | −1.5 | −1.5 | −1.0 | −1.0 | −1.0 | −0.5 | 0.0 |
| | 5~10 | −1.5 | −1.5 | −1.5 | −1.0 | −1.0 | −0.5 | 0.0 | 0.0 |
| | 10~15 | −1.0 | −1.0 | −1.0 | −1.0 | 0.0 | 0.0 | 0.0 | 0.0 |
| | 15~20 | −1.0 | −1.0 | −1.0 | −0.5 | 0.0 | 0.0 | 0.0 | 0.0 |
| | 20~ | 0.0 | 0.0 | 0.0 | 0.0 | 0.0 | 0.0 | 0.0 | 0.0 |

TABLE 4

(A glossy sheet is designated as the type of the sheet)

| The deceleration rate of the slit scrap transporting roller speed (%) | | Basis Weight (gsm) ~50 | 50~62 | 62~75 | 75~92 | 92~136 | 136~163 | 163~ | 217~ |
|---|---|---|---|---|---|---|---|---|---|
| The width of the slit paper scrap (mm) | ~5 | −2.0 | −2.0 | −1.5 | −1.0 | −1.0 | −1.0 | −1.0 | −0.5 |
| | 5~10 | −2.0 | −2.0 | −1.5 | −1.0 | −1.0 | −1.0 | −0.5 | 0.0 |
| | 10~15 | −1.5 | −1.5 | −1.0 | −1.0 | −1.0 | 0.0 | 0.0 | 0.0 |
| | 15~20 | −1.5 | −1.0 | −1.0 | −0.5 | −0.5 | 0.0 | 0.0 | 0.0 |
| | 20~ | 0.0 | 0.0 | 0.0 | 0.0 | 0.0 | 0.0 | 0.0 | 0.0 |

While the present invention has been described above based on the above-described embodiments, the present invention can be modified as appropriate without deviating from the scope of the present invention.

What is claimed is:

1. A post-processing device comprising:

a sheet transporting section that transports one or more sheets;

a cutting section that cuts the sheet along a transporting direction of the sheet being transported by the sheet transporting section;

a paper piece transporting section that transports a paper piece cut at the cutting section; and a control section that controls transportation of the sheet and transportation of the paper piece, wherein a transporting speed of the paper piece transporting section is set lower than a transporting speed of the sheet transporting section, and wherein the control section sets a deceleration rate of the transporting speed of the paper piece transporting section to the transporting speed of the sheet transporting section according to a cut width of the sheet and a basis weight of the sheet.

2. The post-processing device according to claim 1, wherein the control section further sets the deceleration rate based on one or both of a type of the sheet and a grain direction.

3. The post-processing device according to claim 1, wherein the cutting section is a mechanism for cutting one or both of a top and a bottom of the sheet.

4. The post-processing device according to claim 1, wherein by setting a nip pressure of the paper piece transporting section lower than a nip pressure of the sheet transporting section, the transporting speed of the paper piece transporting section is set lower than the transporting speed of the sheet transporting section.

5. The post-processing device according to claim 1, wherein by setting a friction coefficient of the paper piece transporting section lower than a friction coefficient of the sheet transporting section, the transporting speed of the paper piece transporting section is set lower than the transporting speed of the sheet transporting section.

6. A post-processing device comprising:

a sheet transporting section that transports one or more sheets;

a cutting section that cuts the sheet along a transporting direction of the sheet being transported by the sheet transporting section;

a paper piece transporting section that transports a paper piece cut at the cutting section; and a control section that controls transportation of the sheet and transportation of the paper piece, wherein when the sheet from which the paper piece is cut at the cutting section and which is transported by the sheet transporting section does not run in parallel with the paper piece cut at the cutting section and transported by the paper piece transporting section, the control section sets a transporting speed of the paper piece transporting section lower than a transporting speed of the sheet transporting section.

7. The post-processing device according to claim 6, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, sets the transporting speed of the paper piece transporting section lower than the transporting speed of the sheet transporting section, and wherein the control section performs the judgment based on a stiffness of the sheet.

8. The post-processing device according to claim 6, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, sets the transporting speed of the paper piece transporting section lower than the transporting speed of the sheet transporting section, and wherein the control section performs the judgment based on any one or more of a type of the sheet, a grain direction, a thickness and a cut width of the sheet being transported.

9. The post-processing device according to claim 6, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, the control section sets the transporting speed of the paper piece transporting section lower than the transporting speed of the sheet transporting section.

10. An image forming system comprising:

an image forming device that forms an image on a sheet; and a post-processing device comprising:

a sheet transporting section that transports one or more sheets, a cutting section that cuts the sheet along a transporting direction of the sheet being transported by the sheet transporting section, and a paper piece transporting section that transports a paper piece cut at the cutting section, wherein a transporting speed of the paper piece transporting section is set lower than a transporting speed of the sheet transporting section, wherein the image forming device comprises a control section that controls transportation of the sheet and transportation of the paper piece in the post-processing device, and wherein the control section sets a deceleration rate of the transporting speed of the paper piece transporting section to the transporting speed of the sheet transporting section according to the cut width of the sheet and a basis weight of the sheet.

11. The image forming system according to claim 10, wherein the control section further sets the deceleration rate based on one or both of a type of the sheet and a grain direction.

12. The image forming system according to claim 10, wherein by setting a nip pressure of the paper piece transporting section lower than a nip pressure of the sheet transporting section, the transporting speed of the paper piece transporting section is set lower than the transporting speed of the sheet transporting section.

13. The image forming system according to claim 10, wherein by setting a friction coefficient of the paper piece transporting section lower than a friction coefficient of the sheet transporting section, the transporting speed of the paper piece transporting section is set lower than the transporting speed of the sheet transporting section.

14. An image forming system comprising:

an image forming device that forms an image on a sheet; and a post-processing device having a sheet transporting section that transports one or more sheets, a cutting section that cuts the sheet along a transporting direction of the sheet being transported by the sheet transporting section, and a paper piece transporting section that transports a paper piece cut at the cutting section, wherein the image forming device comprises a control section that controls transportation of the sheet and transportation of the paper piece in the post-processing device, and wherein when the sheet being transported by the sheet transporting section does not run in parallel with the paper piece cut at the cutting section and being transported by the paper piece transporting section, the control section sets a transporting speed of the paper piece transporting section lower than a transporting speed of the sheet transporting section.

15. The image forming system according to claim 14, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, sets the transporting speed of the paper piece transporting section lower than the transporting speed of the sheet transporting section, and wherein the control section performs the judgment based on a stiffness of the sheet.

16. The image forming system according to claim 14, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, sets the transporting speed of the paper piece transporting section lower than the transporting speed of the sheet transporting section, and wherein the control section performs the judgment based on any one or more of a type of the sheet, a grain direction, a thickness and a cut width of the sheet being transported.

17. The image forming system according to claim 14, wherein the control section judges whether the sheet from which the paper piece is cut at the cutting section and which is transported by the sheet transporting section runs in parallel with the paper piece cut at the cutting section and transported by the paper piece transporting section, and, when judging that the paper piece does not run in parallel with the sheet, the control section sets the transporting speed of the paper piece transporting section lower than the transporting speed of the sheet transporting section.

* * * * *